US005419753A

United States Patent [19]

Wang

[11] Patent Number: 5,419,753

[45] Date of Patent: May 30, 1995

[54] ANKLE MASSAGER WITH A REMOVABLE SUPPORTING CUSHION MECHANISM

[76] Inventor: Hong-Shang Wang, No. 12, Dah Hwu, Hwu Pei Lee, Dah Lin Chen, Chia I Hsien, Taiwan, Prov. of China

[21] Appl. No.: 215,249

[22] Filed: Mar. 21, 1994

[51] Int. Cl.[6] ..... A61H 1/02

[52] U.S. Cl. ..... 601/84; 601/31; 601/90

[58] Field of Search ..... 128/882; 601/49, 51, 601/53, 54, 61-65, 18, 21, 22, 70, 93, 97, 98, 101, 104, 90, 84, 27-31, 35; 297/423.42, 423.43, 271, 273; 5/103, 108, 109

[56] References Cited

U.S. PATENT DOCUMENTS 2,265,729 12/1941 Hall ..... 601/104
3,103,925 5/1961 Vogt ..... 601/61
4,697,580 10/1987 Terauchi ..... 601/57
5,063,911 11/1991 Teranishi ..... 601/90
5,107,822 4/1992 Ohashi ..... 601/101

*Primary Examiner*—Robert A. Hafer
*Assistant Examiner*—David Kenealy
*Attorney, Agent, or Firm*—Bacon & Thomas

[57] ABSTRACT

A supporting mechanism for an ankle massager includes a base member, a supporting bracket, a cushion and a frame member. The supporting bracket has a W-shape seating contour for receiving the cushion. The frame member is enclosed to the cushion and the supporting bracket in such a manner that the cushion is sandwiched between the supporting bracket and the frame member. The base member further includes a supporting post which is mechanically engaged with a trigger shaft of the massager.

4 Claims, 3 Drawing Sheets

ANKLE MASSAGER WITH A REMOVABLE SUPPORTING CUSHION MECHANISM

BACKGROUND OF THE INVENTION

1. Field of the Invention

This invention relates to massagers, and more particularly to an ankle massager with a removable supporting cushion mechanism wherein the supporting cushion mechanism can be readily replaced with a cushion having adequate support for the ankle of the user.

2. Description of the Prior Art

The supporting cushion for conventional ankle massagers is injected directly from thermoplastics. The manufacturing of the cushion pad is easy, but the configurations of conventional cushions are too simple and hard to absorb vibrations. An unbearable pressure or ache will be caused to occur when the ankles of the user are seated on the massager for a long period of time. In view of the aforesaid reasons, even through the massager provides an excellent exercise or sport to the ankle, people have little interest to use it.

SUMMARY OF THE INVENTION

It is one object of the present invention to provide a massager with a removable supporting cushion wherein the supporting cushion provides excellent comfort to the ankle.

It is another object of the present invention to provide a removable supporting cushion for a massager wherein the supporting cushion has a simple configuration for easy assembling and disassembling.

In order to achieve the objects set forth, the supporting cushion mechanism includes a base member, a supporting bracket, a cushion and a frame member. The cushion is sandwiched between the supporting bracket and the frame member. The cushion is soft enough to fit the contour of the W-shape bracket. Accordingly, the ankle of the user can seat comfortably and easily on the contour. The defects of the prior art are thus completely solved.

BRIEF DESCRIPTION OF THE DRAWINGS

The structural and operational characteristics of the present invention and its advantages as compared to the known state of the prior art will be better understood from the following detailed description, in conjunction with the attached drawings which show illustratively but not restrictively an example of an ankle massager with a removable cushion mechanism in accordance with a preferred embodiment of the invention. In the drawings.

DETAILED DESCRIPTION OF THE PREFERRED EMBODIMENT

Figure 1:
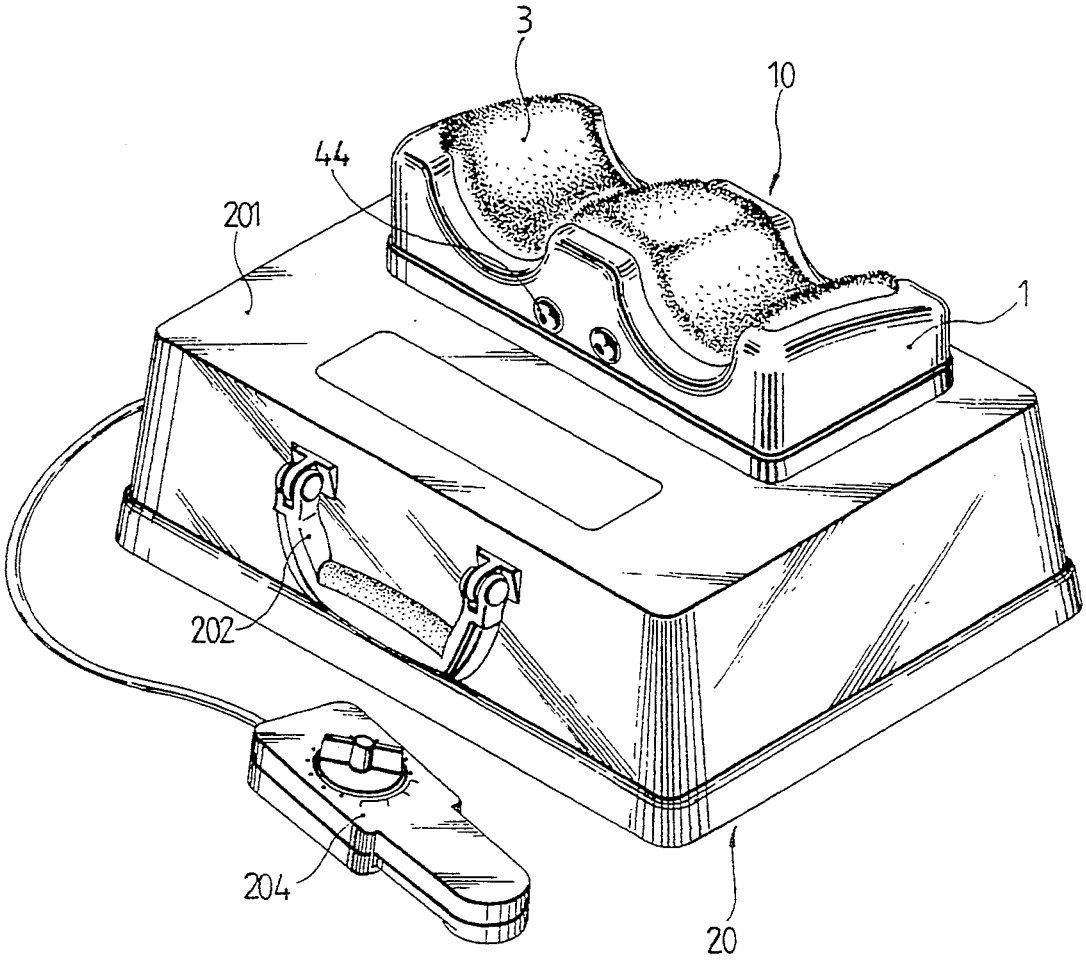
FIG. 1 is a perspective view of an ankle massager with a removable cushion mechanism according to a preferred embodiment of the present invention.
Figure 2:
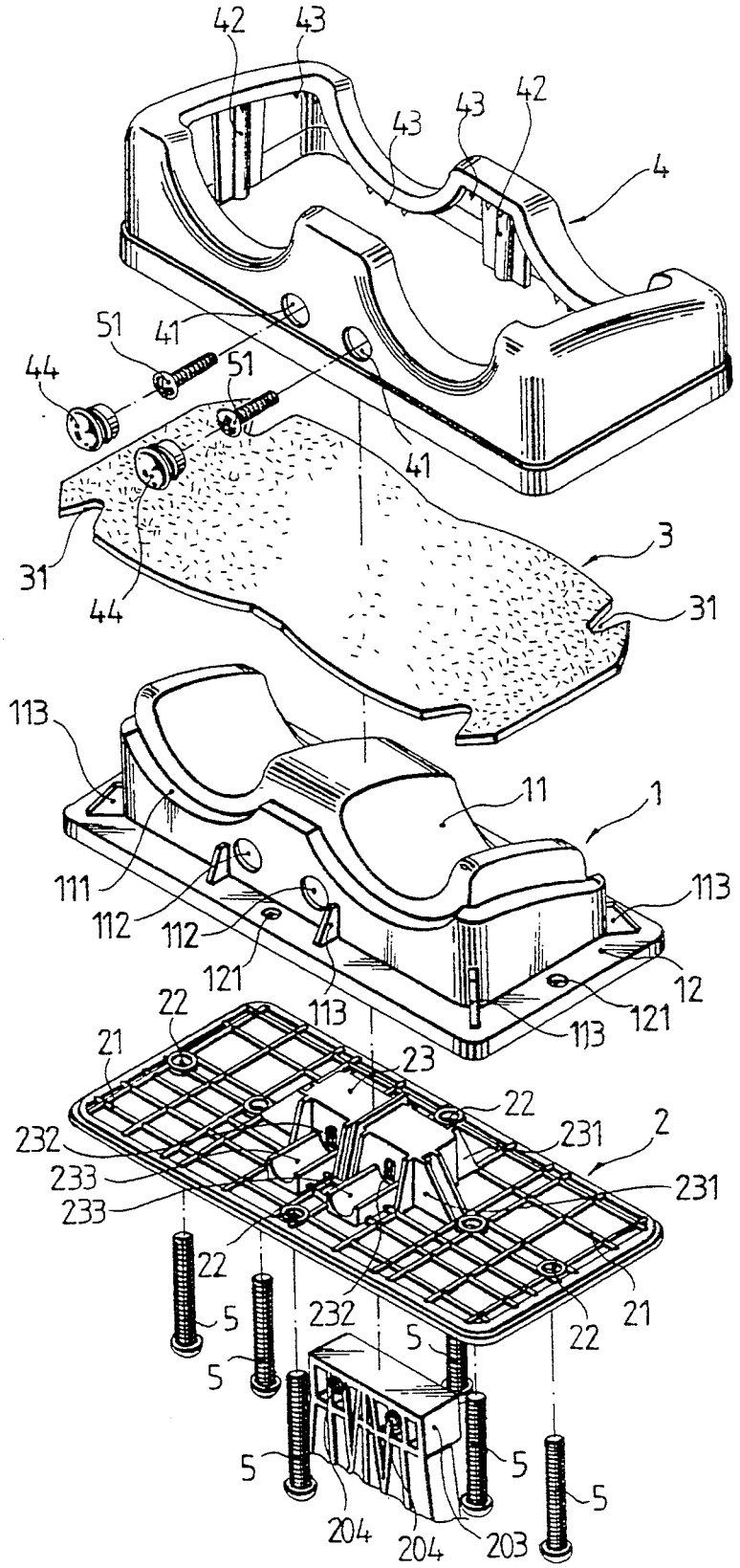
FIG. 2 is an exploded view of the ankle massager shown in FIG. 1.

As shown in FIG. 1, the ankle massager 20 made according to the present invention has a supporting mechanism 10 incorporated thereto. The ankle massager 20 is covered with a casing 201. A handle 202 is disposed at one side side of the casing 201. A motor (not shown) is disposed inside the casing 201 to drive a trigger shaft 203, as shown in FIG. 2. A timer 204 is electrically connected to the ankle massager 20 to facilitate the massager working in a predetermined period of time. Since, the transmission mechanism, the motor and the trigger shaft 203 of the massager are known devices, no further detailed description of the items is required.

The supporting mechanism 10 is disposed at the upper surface of the massager 20 in such a manner that the mechanism 10 is mechanically engaged with the trigger shaft 203 of the massager 20. When the trigger shaft 203 is driven by the motor, the supporting mechanism 10 is reciprocated. When the ankles of the user are seated on the supporting mechanism 10, an adequate and suitable exercise to the ankle is achieved.

As shown in FIG. 2, the supporting mechanism 10 made according to the present invention includes a base member 2, a supporting bracket 1, a cushion 3 and a frame member 4.

The supporting bracket 1 is a hollow casing made of injection-molded plastic. The supporting bracket has a W-shape seating contour 11 at the top. A flange 12 is extended horizontally and outwardly from the lower portion of the supporting bracket 1. A stepper portion 111 is disposed adjacent to the W-shape seating contour 11. A pair of threaded holes 112 are disposed at the front of the stepper portion 111. On the other hand, a plurality of reinforcement ribs 113 are disposed between the stepper portion 111 and the flange 12. Besides, a plurality of holes 121 are disposed at the flange 12. A plurality of meshing posts corresponding to those threaded hole are disposed at the supporting bracket 1.

Figure 3:
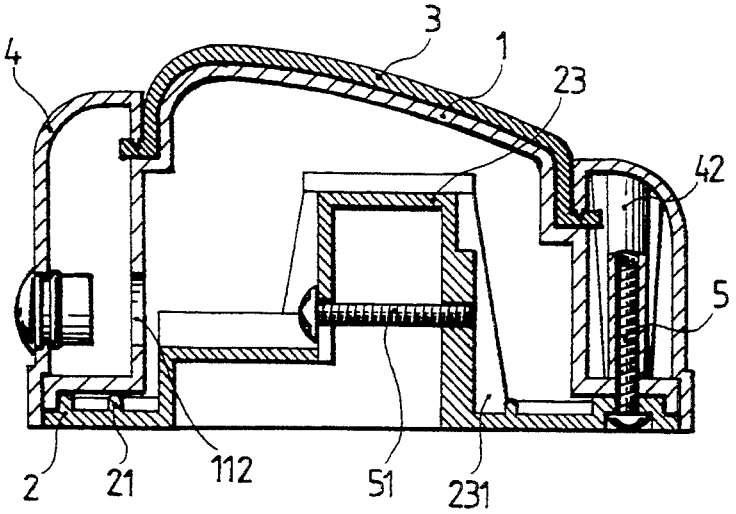
FIG. 3 is a cross sectional view taken on line I—I of FIG. 1.
Figure 4:
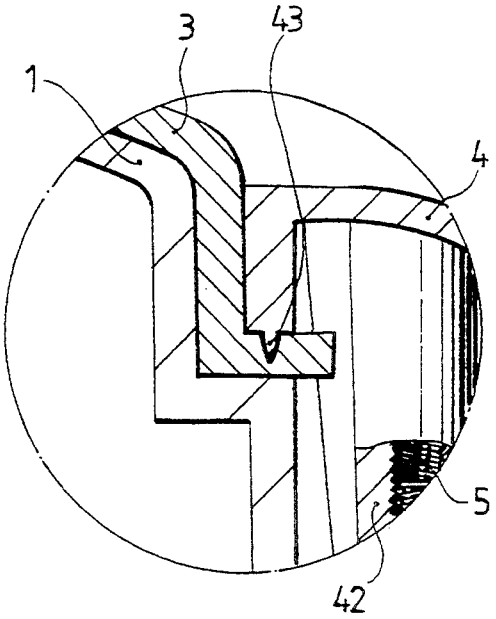
FIG. 4 is an enlarged view of FIG. 3.

A base member 2 is attached to the bottom of the supporting bracket 1, as best shown in FIG. 3. The base member 2 has a planar configuration which further includes a plurality of interposed reinforced ribs 21 at the upper surface portion. A plurality of through holes 22 are provided at the four sides of the base member 2. A hollow supporting post 23 is disposed at the center of the base member 2. The trigger shaft 203 of the massager 20 can be mechanically received by the supporting post 23. On the other hand, the supporting post 23 is provided with a plurality of reinforcement ribs 231. A pair of through holes 232 are provided at the front portion of the supporting post 23. A screw supporting flange 233 is extended horizontally and outward by from the through holes 232.

A cushion 3 made from a soft material, such as a foamed plastic, is seated on the top of the W-shape seating contour 11 of the supporting bracket 1. On the other hand, the surface of the cushion 3 can be provided with a leather or a comfortable material to provide a premium feeling to the ankle. Before the cushion 3 is attached to the W-shape seating contour 11, the cushion 3 is cut to suitable size. The edge of the cushion 3 has cutouts 31 which facilitate a complete engagement with the W-shape seating contour 11 of the supporting bracket 1.

A frame member 4 has a hollow configuration and is enveloped to the supporting bracket 1 together with the cushion 3. The frame member 4 is provided with a pair of holes 41 at the front portion. Each side of the frame member 4 is provided with a respective screw receiving post 42. On the other hand, the ceiling of the frame member 4 is provided with teeth 43 for retaining and positioning the cushion 3 between the supporting bracket 1 and the frame member 4.

In assembling the supporting mechanism 10, the base member 2 is attached to the bottom of the supporting bracket 1 and the cushion 3 is seated compactly to the W-shape seating contour 11 of the supporting bracket 1. After the cushion 3 is completely seated, the frame member 4 is enclosed to the cushion 3 and the supporting bracket 1. Then the screw members 5 are applied to holes 22, 121 to fasten the base member 2, the supporting bracket 1 and the frame member 4 together by means of the engagement between the screw members 5 and the post 42. Then the supporting mechanism 10 is assembled completely. On the other hand, the supporting post 23 of the supporting bracket 2 is mechanically engaged with the trigger shaft 203 of the massager 20. After the supporting post 203 is completely positioned, a pair of screw members 51 are inserted into the through holes 41 to connect the frame member 4 and the supporting member 1 together. Besides, the screw members 51 also pass through the through holes 232 of the supporting post 23 of the supporting bracket 2 and are received by the threaded holes 204 on the trigger shaft 203. By this arrangement, the supporting mechanism 10 and the massager 20 are completely mechanically engaged. Besides, a plug 44 can be inserted into each hole 41 to provide a premium appearance.

The ankle of the user can seat comfortably on the W-shape seating contour 11. When the massager 20 is powered on, the supporting mechanism 10 is reciprocated horizontally, thus providing a comfortable massage to the ankles.

The aforesaid arrangement allows the cushion 3 to be replaced conveniently when it is worn out or damaged.

Although the present invention has been described in connection with the preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. A supporting mechanism for an ankle massager of the type having a trigger shaft and including a base member, a supporting bracket, a cushion and a frame member, wherein:

said supporting bracket has a hollow casing formed from an injected plastic material, said supporting bracket including a W-shape seating contour at the upper portion, a flange being extended horizontally and outwardly from the lower portion of said supporting bracket, a stepper portion being disposed adjacent to said W-shape seating contour, a pair of threaded holes being disposed at the front of said stepper portion, a plurality of reinforcement ribs being disposed between said stepper portion and said flange, a plurality of holes being disposed at said flange, a plurality of meshing posts corresponding to said threaded holes being disposed at said supporting bracket;

said base member is attached to the bottom of said supporting bracket, said base member having a planar configuration which further includes a plurality of interposed reinforcement ribs at an upper portion, a plurality of through holes, a hollow supporting post being disposed at the center of the base member for receiving the trigger shaft of the massager said supporting post being provided with a plurality of reinforcement ribs, a pair of through holes being provided at the front portion of the supporting post, a screw supporting flange being extended horizontally and outwardly from the through holes;

said cushion is made from a soft material and seated on the top of the W-shape seating contour of said supporting bracket; and said frame member has a hollow configuration and being enveloped to said supporting bracket together with said cushion, said frame member being provided with a pair of holes at the front portion, and a plurality of screw receiving posts.

2. A supporting mechanism as recited in claim 1, wherein said frame member has a plurality of teeth for retaining and positioning said cushion.

3. A supporting mechanism as recited in claim 1, wherein a plurality of reinforcement ribs are disposed between said stepper and said flange.

4. A supporting mechanism as recited in claim 1, further including a plurality of bolt members for assembling the supporting mechanism.

* * * * *